United States Patent [19]

Gorring et al.

[11] 4,153,540

[45] May 8, 1979

[54] UPGRADING SHALE OIL

[75] Inventors: Robert L. Gorring, Washington Crossing, Pa.; Robert L. Smith, Hopewell, N.J.

[73] Assignee: Mobil Oil Corporation, New York, N.Y.

[21] Appl. No.: 793,706

[22] Filed: May 4, 1977

[51] Int. Cl.[2] ..... C10G 23/04

[52] U.S. Cl. ..... 208/89; 208/216 R; 208/254 H

[58] Field of Search ..... 208/89, 111, 210

[56] References Cited

U.S. PATENT DOCUMENTS

| | | | |
|---|---|---|---|
| 3,272,734 | 9/1966 | MacLaren | 208/89 |
| 3,506,568 | 4/1970 | Annesser et al. | 208/89 |
| 3,755,138 | 8/1973 | Chen et al. | 208/111 |
| 3,764,520 | 10/1973 | Kimberlin, Jr. et al. | 208/89 |
| 3,980,550 | 9/1976 | Gorring et al. | 208/111 |

*Primary Examiner*—George Crasanakis

*Attorney, Agent, or Firm*—Charles A. Huggett; Michael G. Gilman; Raymond W. Barclay

[57] ABSTRACT

Liquid products from retorting oil shale are upgraded to a total liquid suited to pipeline transport and containing increased amounts of the premium products gasoline through distillate fuel by hydrotreating to convert sulfur, oxygen, nitrogen and metal constituents and cascading the hydrotreater effluent through a hydrocracking reactor containing a catalyst which is characterized by a crystalline zeolite having a silica/alumina ratio greater than 12 and a constraint index of 1 to 12, for example zeolite ZSM-5.

8 Claims, 1 Drawing Figure

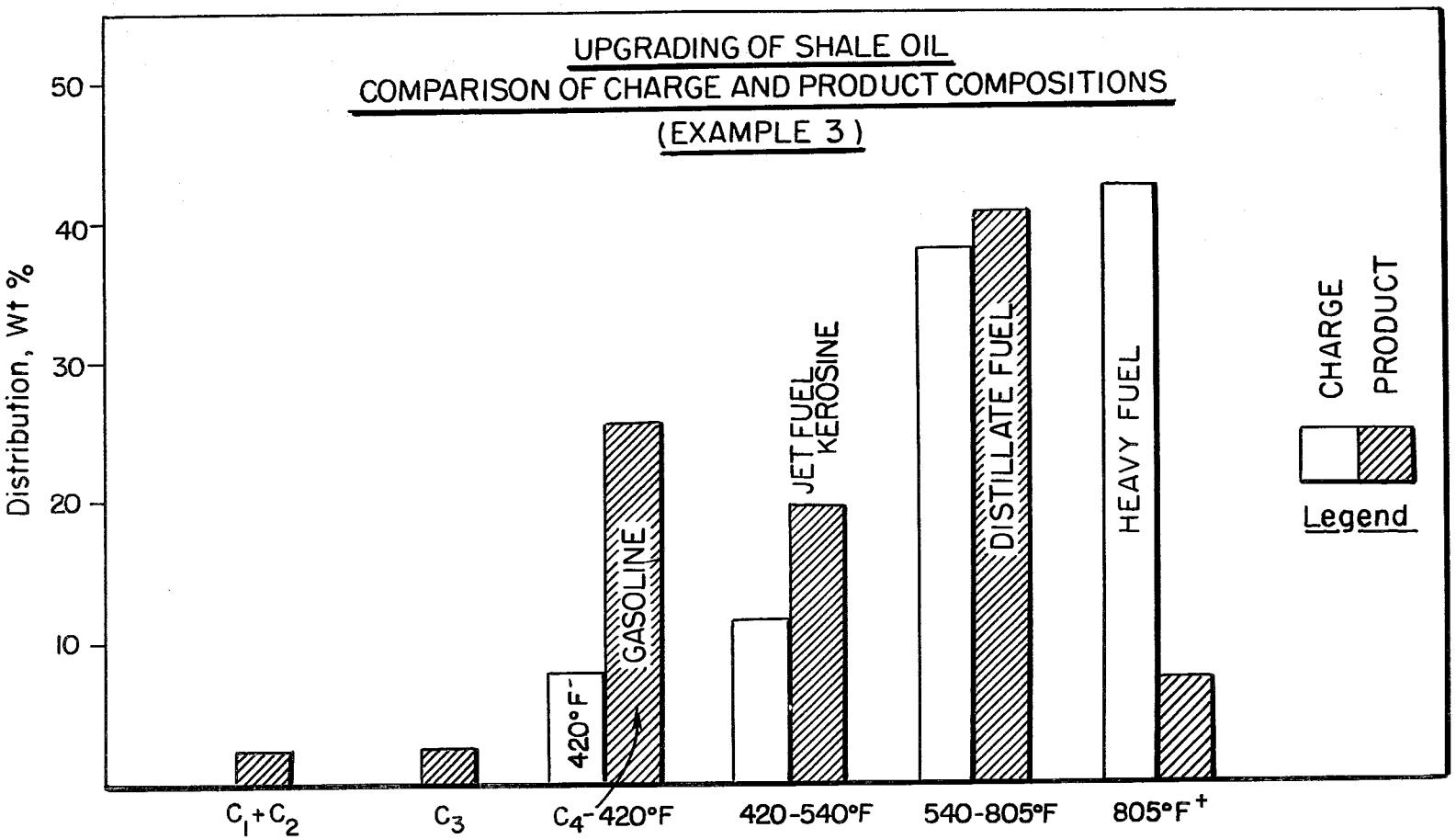
UPGRADING OF SHALE OIL
COMPARISON OF CHARGE AND PRODUCT COMPOSITIONS
(EXAMPLE 3)
Legend
CHARGE
PRODUCT
HEAVY FUEL
DISTILLATE FUEL
JET FUEL
KEROSINE
GASOLINE
420°F-
$C_1+C_2$
$C_3$
$C_4$-420°F
420-540°F
540-805°F
805°F+
Distribution, Wt %
50
40
30
20
10

UPGRADING SHALE OIL

FIELD OF THE INVENTION

This invention relates to treatment of "shale oil" derived by retorting of naturally occurring oil shale. The invention provides a method for treating shale oil in the vicinity of the retorting step to render the oil suitable for transport by pipeline and concurrently converting a substantial portion of the shale oil to premium grade fuels such as gasoline, kerosene, jet fuel, diesel fuel, distillate fuel oil (No. 2 fuel) and the like.

BACKGROUND OF THE INVENTION

It has long been known that oil may be extracted by heat from various extensive deposits of porous minerals, known by the generic term "oil shale," which are permeated by a complex organic material called "kerogen." Upon application of heat, the kerogen is converted to a complex mixture of hydrocarbons and hydrocarbon derivatives which may be recovered from a retort as a liquid shale oil product.

The shale oil so recovered contains various compounds of oxygen, sulfur, nitrogen and heavy metals combined with the carbon and hydrogen of desired hydrocarbon products. For the most part, the components of shale oil have boiling points in the upper levels of boiling ranges of natural petroleum, say upwards of 50% of the total boiling above about 750° F. Such high boiling fractions are unsuited to use in premium grade fuels. Even after requisite removal of sulfur, nitrogen and metals, these fractions must be processed further or sold as the cheaper grades of heavy fuel such as No. 6, Bunker Oil, etc.

In addition, the shale oil contains a relatively high proportion of straight chain aliphatic compounds of high molecular weight typical of hydrocarbon waxes. These long carbon chain compounds tend to crystallize on cooling of the oil to an extent such that the oil will not flow, hence may not be pumped or transported by pipeline. The temperature at which such mixture will not flow is designated the "pour point," determined by standarized test procedures.

The pour point problem can be overcome by techniques known in the art for removal of waxes or conversion of those compounds to other hydrocarbons which do not crystallize at ambient temperatures. An important method for so converting waxy hydrocarbons is shape selective cracking or hydrocracking utilizing principles described in U.S. Pat. No. 3,140,322 dated July 7, 1964. Zeolitic catalysts for selective conversions of wax described in the literature include such species as mordenite, with or without added metal to function as a hydrogenation catalyst.

Particularly effective catalysts for catalytic dewaxing include zeolite ZSM-5 and related porous crystalline aluminosilicates as described in U.S. Pat. No. Re. 28,398 (Chen et al.) dated Apr. 22, 1975. As described in that patent, drastic reductions in pour point are achieved by catalytic shape selective conversion of the wax content of heavy stocks with hydrogen in the presence of a dual-functional catalyst of a metal plus the hydrogen form of ZSM-5. The conversion of waxes is by scission of carbon to carbon bonds (cracking) and production of products of lower boiling point than the waxes. However, only minor conversion occurs in dewaxing. For example, Chen et al. describe hydrodewaxing of a full range shale oil having a pour point of +80° F. to yield a pumpable product of pour point at −15° F. The shift of materials from the fraction heavier than light fuel oil to lighter components was in the neighborhood of 9% conversion.

SUMMARY OF THE INVENTION

The present invention constitutes an advance and improvement on hydrodewaxing using ZSM-5 catalyst in providing for removal in large part of sulfur, oxygen and nitrogen as well as metals from shale oil while simultaneously converting a major portion of the charge boiling above premium grades, say above 750° F., to lower boiling materials suited to processing for manufacture of gasoline, kerosene, jet fuel, diesel fuel, distillate heating oil and the like. That result is accomplished by an initial hydrotreating of the shale oil to convert sulfur, nitrogen and oxygen derivatives of hydrocarbons to hydrogen sulfide, ammonia and water while depositing metal from hydrodecomposition of organometal compounds. The effluent from the hydrotreater, containing hydrogen, hydrocarbons, hydrogen sulfide, ammonia and water is passed to a high severity hydrocracking zone over catalyst containing a zeolite such as HZSM-5 and a metal having activity to catalyze hydrogenation/dehydrogenation reactions. Hydrocracking conditions of temperature, pressure and hydrogen concentration are adjusted to result in conversion to lighter products of at least 50% (preferably 70%) of material in the charge boiling above about 750° F.

DESCRIPTION OF DRAWING

Nature of typical conversion achieved by the invention is illustrated in the bar chart of the single FIGURE of the drawing annexed.

DESCRIPTION OF SPECIFIC EMBODIMENTS

The upgrading of shale oil dramatically shown by the bar chart is achieved by use in cascade fashion of two catalysts previously known in the art under conditions hereinafter described.

The catalyst of the first stage may be any of the known hydrotreating catalysts, many of which are available as staple articles of commerce. These are generally constituted by a metal or combination of metals having hydrogenation/dehydrogenation activity on a relatively inert refractory carrier having large pores in the general vicinity of 100 Angstrom Units or more diameter. Suitable metals are nickel, cobalt, molybdenum, vanadium, chromium, etc., often in such combinations as cobalt-molybdenum, nickel-cobalt-molybdenum. The carrier is conveniently a wide pore alumina, or a zirconia-titania composite and may be any of the known porous refractories, preferably of little or no inherent catalytic activity.

The second stage catalyst is characterized by a zeolite similar in properties to zeolite ZSM-5 together with a metal having hydrogen/dehydrogenation activity.

Definition of a class of zeolites suitable for use in the present invention is found in U.S. Pat. No. 3,968,024 (Gorring and Shipman) granted July 6, 1976, the disclosure of which is hereby incorporated by reference. Zeolites used in the second stage catalyst will have silica/alumina ratios above 12 and constraint indices of 1 to 12 as defined in the Gorring and Shipman patent. Preferably the zeolites in that second stage catalyst will be in the form of crystals having a size of less than about 0.05 microns, also as described in that patent. See also U.S. Pat. No. 3,926,782 (Plank, Rosinski and Schwartz) dated Dec. 16, 1975.

The zeolite of the second stage catalyst is combined with metal having hydrogenation/dehydrogenation promotion properties in minor amount. Preferred metals are those of Group VIII of the Periodic Table. Palladium is highly effective, as are the other Group VIII noble metals platinum, iridium, osmium, ruthenium and rhodium. Nickel, cobalt, etc., are effective. Other metals, particularly those commonly called transition metals may be employed. The metals may be used alone or in combination, e.g., palladium and zinc, although there are some indications that combinations with zinc in certain configurations may show faster aging in use. The metals may be incorporated in the finished catalyst by any of the techniques well known in the art such as base exchange, impregnation and the like.

Conditions for effective hydrotreating are well known and need no detailed review except to note that cascading the hydrotreater effluent to the second stage requires that sufficient hydrogen be supplied with charge to the hydrotreater that requirements of both stages shall be satisfied. Pressure of the hydrotreating operation is adjusted to obtain desired conversion of sulfur, nitrogen, metal and oxygen compounds and is preferably enough greater than pressure desired in the second stage that inter-stage compressors can be avoided. Generally it will be found desirable to employ higher temperature in the second than in the first stage to achieve high conversion to lower boiling products in the second stage. This is accomplished by inter-stage heating. Space velocities for the two stages are adjusted by sizes of catalyst beds.

Reaction conditions of temperature, pressure and space velocity in the second stage are adjusted to a severity of operations which will result in high conversion of the charge stock such that at least 50%, preferably 70% of the shale boiling above about 750° F. shall be converted to products boiling below 750° F. Conversions on the order of 80% are readily achieved. For that purpose, temperatures will be in the range of 750°-1000° F. at pressures between 500 and 1500 psig and space velocity from 0.25 to 1 volumes of charge per volume of catalyst per hour. Hydrogen will be supplied at rates of 5-6 moles per mole of charge.

Experimental runs have been conducted in a laboratory scale reactor mounted in a furnace for temperature control to achieve isothermal conditions in the two reaction stages. The results obtained constitute the basis for predicting like results in adiabatic full-scale reactors with interstage heating. The reactor was arranged for flow downward through successive beds in the reaction tube with measurement of temperatures in the beds by thermocouples. Products were drawn to a high pressure separator maintained at about 330° F. from which gases were withdrawn and scrubbed with sodium hydroxide solution to remove hydrogen sulfide and with sulfuric acid solution to remove ammonia. Liquid from the high pressure separator was collected in a receiver at about 200° F.

Inspection data on two representative charge stocks derived by retorting shale oil are shown in Table 1.

TABLE 1

| Properties of Shale Oils | | |
|---|---|---|
| Charge Stock Code | A | B |
| Elemental Analysis, % | | |
| Hydrogen | 11.18 | 11.24 |

TABLE 1-continued

| Properties of Shale Oils | | |
|---|---|---|
| Charge Stock Code | A | B |
| Nitrogen, Total | 2.11 | 1.86 |
| Basic | 1.24 | 0.69 |
| Oxygen | 1.4 | 1.3 |
| Sulfur | 0.56 | 0.71 |
| Nickel | 0.00055 | 0.00016 |
| Iron | 0.0100 | 0.0095 |
| Vanadium | 0.00005 | 0.0001 |
| Arsenic | 0.00335 | — |
| Ash | 0.01 | 0.5 |
| Bromine No. | 42.9 | 43.9 |
| Carbon Residue (Conradson) | 2.28 | 2.78 |
| Vacuum Distillation, 10 mm (D 1160) °F. (Corrected) | | |
| IBP | 427 | 407 |
| 5% | 501 | 439 |
| 10 | 531 | 473 |
| 20 | 590 | 543 |
| 30 | 652 | 604 |
| 40 | 712 | 662 |
| 50 | 766 | 713 |
| 60 | 812 | 763 |
| 70 | 858 | 804 |
| 80 | 919 | 843 |
| 90 | 994 | 986 |
| 95 | 1068 | 919 |
| Gravity, API | 21.5 | 20.5 |
| Viscosity, Cs at 100° F. | 56.57 | 25.53 |
| Cs at 210° F. | 6.23 | 3.95 |
| Pour Point, °F. | 85 | 80 |

EXAMPLE 1

In a typical run, the hydrotreating catalyst was 5.0% cobalt oxide, 11.3% molybdenum oxide and 0.11 nickel oxide on alumina having a surface area of 166 square meters per gram and average pore diameter of 104 Angstrom units. The second stage catalyst was small crystallite (0.5 average) HZSM-5 containing 0.02 wt. % sodium and 0.9 wt. % nickel bonded by alumina which constituted 35 wt. % of the particles of catalyst. Operating conditions and character of the product in treating shale oil A are shown in Table 2.

TABLE 2

| Shale Oil Upgrading | | |
|---|---|---|
| Time on Stream, Days | | 5.8 |
| Temp., °F. average | | |
| 1st stage | | 755 |
| 2nd stage | | 874 |
| Pressure, psig | | 750 |
| $H_2$, SCFB* | | 2500 |
| Space Velocity | | |
| 1st stage | | 0.33 |
| 2nd stage | | 1.00 |
| Overall | | 0.25 |
| Products, wt. % | Charge | |
| $C_1$ | 0 | 1.29 |
| $C_2$ | 0 | 1.39 |
| $C_3$ | 0 | 2.18 |
| $C_4$ | 0 | 2.77 |
| $C_5$ - 330° F. | 0.4 | 13.8 |
| 330-420 | 4.1 | 8.80 |
| 420-538 | 12.3 | 19.4 |
| 538-690 | 18.6 | 26.8 |
| 690-805 | 17.7 | 14.6 |
| $805^+$ | 47.0 | 7.9 |
| $NH_3$ | | 1.42 |
| $H_2O$ | | 1.37 |
| $H_2S$ | | 0.57 |
| Consumption $H_2$, SCFB* | | 1303 |
| Liquid analysis | | |
| Hydrogen | 11.18 | 12.60 |
| Nitrogen, Total | 2.11 | 1.05 |
| Basic | 1.24 | 0.72 |
| Oxygen | 1.4 | 0.2 |

TABLE 2-continued

| Shale Oil Upgrading | | |
|---|---|---|
| Sulfur | 0.56 | 0.029 |
| Pour Point, °F. | 85 | 30 |

*SCFB, standard cubic feet per barrel of charge

**Space velocity, volumes of charge per volume of catalyst per hour

Examination of the data in Table 2 shows a net conversion of higher boiling components to products boiling below 420° F. of 25.7% at naphtha selectivity of 81%. Net conversion to products boiling below 690° F. was 41% at selectivity to naphtha plus distillate fuel of 88%. Total yield of upgraded naphtha plus distillate fuel was 86.2% based on charge. Inspection data on selected liquid fractions are shown in Table 3.

TABLE 3

| Product Fraction Properties | | | | | |
|---|---|---|---|---|---|
| Boiling Range, °F. | IBP-432 | 432–523 | 523–654 | 654–800 | 800+ |
| N, wt. % | 0.61 | 1.13 | 1.27 | 1.23 | 1.32 |
| O | — | — | 0.2 | — | — |
| S | 0.0111 | 0.001 | 0.008 | 0.019 | 0.044 |
| Ni, ppm | | | | | 0.7 |
| V, ppm | | | | | 0.1 |
| PONA | | | | | |
| Aromatics | 14.9 | | | | |
| Naphthenes | 22.7 | | | | |
| Olefins | 17.8 | | | | |
| Paraffins | 44.1 | | | | |
| Octane Number | | | | | |
| R + O | 57.4 | | | | |
| R + 3TEL | 79.0 | | | | |
| Pour Point, °F. | −30 | −30 | 25 | | |
| Smoke Point | | 13.2 | | | |

EXAMPLE 2

A long term run was conducted with the same charge stock and catalysts as in example 1. Material balances were conducted at intervals of three to seven days with increase in temperature to maintain severity of reaction. Three of the eight balances are shown in Table 4.

TABLE 4

| Shale Oil Upgrading | | | |
|---|---|---|---|
| Time on Stream, Days | 3.8 | 27.8 | 34.8 |
| Temp., °F. average | | | |
| 1st stage | 715 | 753 | 751 |
| 2nd stage | 847 | 870 | 870 |
| Pressure, psig | 1000 | 1000 | 550 |
| $H_2$, SCFB | 4000 | 4000 | 4000 |
| Space Velocity | | | |
| 1st stage | 0.33 | 0.33 | 0.33 |
| 2nd stage | 1.00 | 1.00 | 1.00 |
| Overall | 0.25 | 0.25 | 0.25 |
| Product, wt. % | | | |
| $C_1$ | 0.90 | 1.19 | 1.29 |
| $C_2$ | 0.90 | 1.19 | 1.19 |
| $C_3$ | 1.20 | 1.58 | 1.48 |
| $C_4$ | 1.10 | 1.19 | 1.09 |
| $C_5$ | 10.9 | 10.5 | 6.13 |
| 330–420 | 8.07 | 9.09 | 7.32 |
| 420–538 | 19.1 | 19.4 | 18.5 |
| 538–690 | 28.4 | 28.1 | 29.0 |
| 690–805 | 17.2 | 16.1 | 18.7 |
| 805+ | 11.9 | 10.6 | 14.2 |
| $NH_3$ | 1.29 | 1.45 | 0.91 |
| $H_2O$ | 0.61 | 1.26 | 1.16 |
| $H_2S$ | 0.53 | 0.56 | 0.53 |
| $H_2$ Consumption, SCFB | 1190 | 1225 | 839 |
| Liquid Analysis, Wt. % | | | |
| Hydrogen | 12.69 | 12.64 | 12.04 |
| Nitrogen, Total | 1.10 | 0.98 | 1.46 |
| Basic | 0.78 | 0.70 | 1.18 |
| Oxygen | 0.9 | 0.3 | 0.4 |
| Sulfur | 0.06 | 0.031 | 0.065 |

TABLE 4-continued

| Shale Oil Upgrading | | | |
|---|---|---|---|
| Pour Point, °F. | 50 | 65 | 60 |

EXAMPLE 3

Shale oil B was converted in accordance with this invention in a two stage reactor in which the second stage catalyst was the same as in Example 1. The hydrotreating catalyst in the first stage was nickel-cobalt-molybdenum on a porous composite of titania-zirconia-alumina. Conditions and results appear in Table 5.

TABLE 5

| Upgrading of Shale Oil B | | | |
|---|---|---|---|
| Time on Stream, Days | 8 | 16 | 22 |
| Temperature, °F. average | | | |
| 1st stage | 714 | 749 | 748 |
| 2nd stage | 846 | 870 | 869 |
| Pressure, psig | 1000 | 1000 | 1000 |
| $H_2$, SCFB | 4000 | 4000 | 4000 |
| Space Velocity | | | |
| 1st stage | 0.33 | 0.33 | 0.66 |
| 2nd stage | 1.0 | 1.0 | 2.0 |
| Overall | 0.25 | 0.25 | 0.5 |
| Yields, wt. % | | | |
| $C_1$ | 0.69 | 0.99 | 0.89 |
| $C_2$ | 0.88 | 1.18 | 1.09 |
| $C_3$ | 1.57 | 2.27 | 1.68 |
| $C_4$ | 1.57 | 2.27 | 1.38 |
| $C_5$ | 8.46 | 13.8 | 10.3 |
| 330–420 | 9.44 | 9.76 | 8.09 |
| 420–538 | 17.1 | 19.6 | 18.3 |
| 538–690 | 25.8 | 26.2 | 27.8 |
| 690–805 | 16.9 | 14.4 | 17.9 |
| 805+ | 15.9 | 8.09 | 11.4 |
| $NH_3$ | 1.87 | 1.80 | 1.24 |
| $H_2O$ | 1.36 | 1.36 | 1.36 |
| $H_2S$ | 0.75 | 0.75 | 0.75 |
| $H_2$ Consumption, SCFB | 1357 | 1470 | 1194 |
| Liquid Analysis, Wt. % | | | |
| Hydrogen | 13.00 | 13.02 | 12.72 |
| Nitrogen, Total | 0.34 | 0.41 | 0.90 |
| Basic | 0.35 | 0.30 | 0.65 |
| Oxygen | 0.1 | 0.1 | — |
| Sulfur | 0.002 | 0.002 | 0.002 |
| Pour Point | 60 | 55 | 65 |
| Conradson Carbon, % | 0.02 | 0.3 | 0.10 |

The nature of the shift to lower boiling premium products is brought out by the bar chart comparison in the drawing of amounts of liquid in appropriate boiling ranges of charge and product from the run described in this example. A composite of liquid collected from three successive balances, including that at 16 days is reported by fractions in Table 6.

TABLE 6

| Properties of Fractions from Upgrading Shale Oil | | | | | |
|---|---|---|---|---|---|
| Boiling Range, °F. | IBP-415 | 415–508 | 508–637 | 637–800 | 800+ |
| Wt. % | 24.6 | 13.5 | 28.3 | 26.7 | 6.9 |
| Elemental, Wt. % | | | | | |
| Hydrogen | 14.07 | | | | |
| Nitrogen, Total | 0.19 | 0.56 | 0.54 | 0.49 | 0.44 |
| Basic | 0.18 | | | | |
| Oxygen | 0.17 | 0.11 | 0.14 | 0.16 | 0.03 |
| Sulfur | 0.0248 | 0.001 | 0.002 | | |
| PONA | | | | | |
| Aromatics | 18.0 | | | | |
| Naphthenes | 27.2 | | | | |
| Olefins | 8.4 | | | | |
| Paraffins | 45.8 | | | | |
| Octane Number | | | | | |
| R + O | 54.3 | | | | |

TABLE 6-continued

| Properties of Fractions from Upgrading Shale Oil | | | | |
|---|---|---|---|---|
| R 3TEL | 89.7 | | | |
| Bromine Number | | 5.6 | | |
| Pour Point, °F. | | −45 | 15 | 75 |
| Cloud Point, °F. | | −46 | 24 | |

We claim:

1. In a process for upgrading full range shale oil derived by retorting oil shale which process is conducted by contacting said full range shale oil in the presence of hydrogen with a composite dewaxing catalyst comprising a metal and a crystalline zeolite consisting essentially of one having a silica/alumina ratio greater than 12 and a constraint index of about 1 to 12, the improvement which comprises:

contacting said full range shale oil in admixture with hydrogen with a hydrotreating catalyst at hydrotreating conditions to convert organic compounds of sulfur, nitrogen, oxygen and metal and passing substantially the entire effluent of such hydrotreating in cascade fashion into contact with said dewaxing catalyst at conversion conditions of temperature, pressure, space velocity and hydrogen concentration of a severity to hydrodewax the shale oil while simultaneously converting at least 50% of the shale oil boiling above about 750° F. to reaction products boiling below 750° F.; said severity including a temperature of 750° to 1000° F. and space velocity of 0.25 to 1 volumes of said shale oil per volume of catalyst per hour.

2. A process according to claim 1 wherein the metal of said dewaxing catalyst is nickel.

3. A process according to claim 1 wherein the metal of said dewaxing catalyst is palladium.

4. A process according to claim 1 wherein said severity includes a pressure of 500 to 1500 psig.

5. A process according to claim 1 wherein said hydrogen is supplied at a rate of 5 to 6 moles per mole of said shale oil.

6. A process according to claim 1 wherein said severity is at a level to convert at least 70% of the shale oil boiling above 750° F. to products boiling below 750° F.

7. A process according to claim 6 wherein said metal is palladium.

8. A process according to claim 1 wherein said composite consists essentially of said metal and said zeolite.

* * * * *

UNITED STATES PATENT AND TRADEMARK OFFICE

CERTIFICATE OF CORRECTION

PATENT NO. : 4,153,540

DATED : May 8, 1979

INVENTOR(S) : ROBERT L. GORRING and ROBERT L. SMITH

It is certified that error appears in the above-identified patent and that said Letters Patent are hereby corrected as shown below:

Column 4, line 37 "(0.5 average)" should be —(0.05 average)—.

Column 7, line 3 "R 3TEL" should be —R + 3TEL—.

Signed and Sealed this

*Twenty-third* Day of *October 1979*

[SEAL]

*Attest:*

RUTH C. MASON
*Attesting Officer*

LUTRELLE F. PARKER
*Acting Commissioner of Patents and Trademarks*